United States Patent [19]

Robinson

[11] 4,279,640

[45] Jul. 21, 1981

[54] PROCESS FOR UPGRADING IRON-CONTAINING MATERIALS

[75] Inventor: Michael Robinson, Wooton, England

[73] Assignee: Laporte Industries Limited, London, England

[21] Appl. No.: 117,068

[22] Filed: Jan. 31, 1980

[30] Foreign Application Priority Data

Feb. 21, 1979 [GB] United Kingdom ..... 6157/79
Oct. 23, 1979 [GB] United Kingdom ..... 36646/79

[51] Int. Cl.[3] ..... C22B 1/10
[52] U.S. Cl. ..... 75/1 R; 75/26
[58] Field of Search ..... 75/1 R, 26

[56] References Cited

U.S. PATENT DOCUMENTS

| | | | |
|---|---|---|---|
| 2,752,301 | 6/1956 | Cooper | 75/1 R |
| 2,993,759 | 7/1961 | Schreiner | 75/1 R |
| 3,473,916 | 10/1969 | Severns | 75/26 |

*Primary Examiner*—P. D. Rosenberg

*Attorney, Agent, or Firm*—Kane, Dalsimer, Kane, Sulllivan and Kurucz

[57] ABSTRACT

Material containing iron in combination with chromium, such as chromite ore or sand, may be upgraded by removing at least some iron by a fluidized bed process in which iron is chlorinated to ferrous chloride in the presence of carbon and the ferrous chloride vapor removed. Selectivity of the process in reducing or avoiding the chlorination of the chromiUm content of the ore and in reducing or avoiding the formation of ferric chloride, with resulting increased chlorine usage efficiency, may be achieved by control of process parameters such as bed depth, chlorine concentration, and temperature. The invention may be used to produce a suitable raw material for the production of ferrochrome, which generally requires a chromium to iron ratio of at least 3:1, from an initial material in which the said ratio is below 2:1, either by upgrading the bulk of the material to the desired level or a portion to above the required level and blending the product with untreated material.

25 Claims, No Drawings

PROCESS FOR UPGRADING IRON-CONTAINING MATERIALS

BACKGROUND OF THE INVENTION

1. Field of the Invention

This invention relates to the upgrading of materials containing oxide of iron in combination with oxide of chromium, for example, chromite. By "upgrading" we mean removal of at least some iron thereby to increase the proportion of chromium. Reference to "material" hereafter, unless otherwise specified, is to the aforesaid material and reference to "iron" or "chromium" unless otherwise specified is to the iron or chromium content of the material,or of the upgraded or partially upgraded material present as oxide.

2. Brief Description of the Prior Art

Chromite is a material having a spinel structure based on the theoretical formula $FeO.Cr_2O_3$ which is varied in nature by the partial replacement of iron 2+ ions by magnesium 2+ ions and by the partial replacement of chromium 3+ ions by aluminium 3+ or iron 3+ ions. Chromite usually also contains a significant proportion of oxides of silicon and may also contain a small proportion of oxides of some or all of calcium, manganese, niobium, vanadium and titanium.

Chromite is the primary source of chromium for industrial or metallurgical use. There are major ore deposits of chromite on the African continent, particularly in the Transvaal region of South Africa, in the Philippines, in New Caledonia, in Turkey and in the USSR. There are also large deposits of chromite sand in South Africa.

The chromium content of natural chromite deposits varies considerably.

There are large deposits of low grade chromite in which the chromium content, calculated as $Cr_2O_3$, is below 50% and in which there is a relatively high iron content giving a chromium to iron ratio which may be below 2:1. Such ores, because of their high iron content, may require processing to upgrade them if they are to be usable, for example, for the production of "ferrochrome" for which use a chromium to iron ratio, generally, of at least 3:1 and, certainly, well above 2:1 is required.

High grade chromite may show chromium contents, calculated as $Cr_2O_3$, of 50% to 55% by weight and a chromium to iron ratio well over 3:1. These high grade ores are suitable for the production of chromium/iron alloys containing in the region of about 60% to 70% of chromium commonly known collectively as "ferrochrome". Nevertheless, even high grade ores may have to be upgraded for other purposes such as, for example, the production of a high chromium beneficiate, and it is within the present invention to do so.

The physical form of natural chromite deposits also affects the ease with which they may be exploited. For example, the large deposits of chromite sand in South Africa are composed of relatively low grade chromite and are particularly difficult to upgrade because of their fine particle size.

The problem of increasing the chromium to iron ratio of chromite deposits has been the subject of much investigation which investigation is summarised succinctly in the introductory portion of U.S. Pat. No. 3,216,817. That patent concludes that prior process for the selective chlorination of chromium ores to remove only the iron content is difficult due to the affinity of both iron and chromium for chlorine at high temperatures, that while the use of carbon as a reducing agent together with a chlorinating agent such as chlorine offers the possibility of certain practical advantages it had been found to more readily effect complete chlorination of the chromite ore constituents and consequently to be less conductive to use in selective chlorination methods and that the prior art had theretofore been unsuccessful in achieving selective chlorination with chlorine and carbon in a practical manner to produce an upgraded ore beneficiate having a satisfactory chromium to iron content.

An object of U.S. Pat. No. 3,216,817 is to alleviate the problem noted above. According to the process disclosed in that patent chromium ores may be upgraded by selective chlorination in the presence of carbon in a fluidised bed to convert iron oxide in the ore to ferric chloride, volatile ferric chloride being released from the fluidised reaction mass. According to the process disclosed the reaction temperature must be regulated below 920° C. preferably below 900° C. since a higher temperature results in a rapidly increasing loss of chromium from the ore. The use of an excess of chlorine, which may be a 100% excess or even more, is taught. There is continuously discharged from the reactor a stream containing chlorine, nitrogen and carbon oxides. This gives rise to the dual problem of chlorine recovery from admixture with the nitrogen and carbon oxides as well as from iron chloride formed.

The development of the art of fluidised bed selective chlorination of chromium ores is taken a stage farther by U.S. Pat. No. 3,473,916 which proposes operation at a temperature of from 920° C. to 1050° C. but which finds it necessary to use, as a reducing agent, carbon monoxide in the gaseous input to the fluidised bed. The process conditions disclosed in U.S. Pat. No. 3,473,916 would lead to the conversion of the iron content of the ore into ferric chloride.

It would be desirable to conduct a process for upgrading materials containing oxide of iron in combination with oxide of chromium by a selective chlorination in which iron values are converted to ferrous chloride instead of ferric chloride since thereby a very considerable saving in plant capital costs may be possible due to the lower theoretical chlorine requirement of the process. Ferrous chloride vapour, however, is a difficult to handle material which tends to form solid accretions on the inside surfaces of equipment. Nevertheless, U.S. Pat. No. 2,752,301 describes a process for increasing the chromium to iron ratio of chromite by selectively forming and subliming ferrous chloride. The process described in that patent essentially involves, amongst other features, the use of dry hydrogen chloride as the reagent, the careful avoidance of free chlorine, and the absence, or substantial absence, of carbon the maximum quantity of carbon allowed being 1 part to 6 parts by weight of any iron oxide left in the ore residue at the end of the reaction.

The present process provides, by careful control of a combination of features as taught hereafter, a process for the upgrading of materials containing oxide of iron in combination with oxide of chromium, such as, for example chromite, by means including the chlorination of iron in the ore to ferrous chloride.

SUMMARY OF THE INVENTION

The present invention provides a process for upgrading a material containing oxide of iron in combination with oxide of chromium by reacting at least a portion of the iron content thereof with chlorine and removing the resulting iron chloride as vapour, characterised in forming a fluidised bed having an expanded bed depth of at least 1 meter said bed comprising the said material in finely divided form and finely divided carbon, the carbon being present in the bed in at least sufficient quantity to react with any oxygen added to or evolved in the bed and in at least 15% of the total weight of the carbon and of the said material, maintaining a reaction temperature of from 900° C. to 1100° C. in the bed, admitting to the bed a chlorine-containing gas giving a concentration of chlorine of from 20% to 60% by volume of the gases added to the the bed and reacting the chlorine with iron present in the said material to produce ferrous chloride, maintaining the partial pressure of ferrous chloride in the gaseous effluent from the bed at a sufficiently low level to prevent liquefaction of the ferrous chloride, removing the gaseous ferrous chloride-containing effluent from the bed and recovering the residual upgraded chromium containing bed material.

DETAILED DESCRIPTION OF THE INVENTION

The material treated in the practice of this invention may typically have an iron content, calculated as Fe, of from about 10% to 30% by weight and a chromium content calculated as $Cr_2O_3$, of from about 25% to 50% by weight. The material may, very suitably, be in the form of an ore which has been ground so that it contains substantially no particles outside the range $75\times10^{-6}$ m to $500\times10^{-6}$ m in diameter with an average particle size of from about $150\times10^{-6}$ m to $250\times10^{-6}$ m in diameter for example from $150\times10^{-6}$ m to $200\times10^{-6}$ m in diameter. By "average" above and hereafter we mean weight mean average.

Alternatively the material may be in the form of a naturally occurring sand, such as a chromite sand, from which the finest particles have been removed and, as a result, having a similar particle size distribution to that just stated. Very suitably, the sand is a fraction having the bulk, say 80%, or, preferably, the whole, by weight within fairly narrow particle size spread for example having a $100\times10^{-6}$ m diameter spread or even a $50\times10^{-6}$ m diameter spread with, preferably, up to 10% being finer and up to 10% being coarser on a weight basis.

The carbon incorporated in the fluidised bed is suitably of a somewhat coarser particle size than that stated above, for example, having an average particle size of from 500 to $800\times10^{-6}$ m in diameter for example $700\times10^{-6}$ m and containing substantially no particles having sizes outside the range $75\times10^{-6}$ m to $2000\times10^{-6}$ m and is preferably a suitably ground coke. The quantity of carbon in the fluidised bed is, essentially, at least 15%, desirably, from 15% to 50% and is, preferably, at least 20%, desirably, from 20% to 50% by weight of the bed. If the upgraded product is intended for metallurgical purposes a content of residual carbon may be acceptable.

The depth, in operation, of the fluid bed affects the practice of this invention. A bed less than 1 meter in depth will tend to produce ferric chloride. A bed greater than 2.5 m in depth, because of its density, is not readily susceptible to fluidisation. The bed depth is, therefore, preferably, from 1.5 to 2.5 m and, particularly preferably, from 1.5 to 2.25 m in depth.

A preferred manner of forming the bed is to fluidise it by means of a flow of the added oxygen, if any, the chlorine, and any inert diluent gas upwardly into a fluidised bed reactor containing the mixture.

The reactions involved in the formation of ferrous chloride are less exothermic than those involved in the formation of ferric chloride and the addition of heat to the fluidised bed is therefore necessary to maintain the desired reaction temperature. Preferably, the desired reaction temperature is maintained under the influence of an exothermic reaction between carbon in the bed and free, that is, not chemically combined, oxygen admitted to the bed. Particularly preferably there is admitted to the bed sufficient free oxygen to maintain the desired reaction temperature. However, the quantity of added free oxygen required may depend, at least in part, on the quantity of oxygen, present initially chemically combined with iron in the bed. Since the quantity of carbon present in the bed is preferably at least sufficient to react with any oxygen present in or added to the bed and, particularly preferably, is in excess of that quantity, the control of the bed temperature may be achieved by control of the quantity of added oxygen. It is highly preferred that the quantity of introduced oxygen introduced at any point in the fluidised bed should not exceed 10% by volume of the total gaseous imput into the bed since this would entail an unduly high temperature in a portion of the bed. If it is impossible to maintain the desired reaction temperature with a single oxygen input giving not more than 10% by volume of the total gaseous input into the bed the expedient of a further oxygen input or inputs at a point in the bed where the initial oxygen concentration has become depleted is, preferably, adopted. The further oxygen input or inputs are controlled so that the preferred maximum oxygen concentration is not exceeded. A further preferred expedient for the practice of this invention is to introduce the chlorine into the fluidised bed a part of the distance up the bed, the fluidising gas introduced into the base of the bed containing a quantity of oxygen above the preferred maximum of 10% by volume but in a quantity such that it becomes depleted to conform to the said maximum at the point of chlorine introduction. Preferably the diameter of the fluidised bed reactor increases stepwise at the point of chlorine introduction to maintain a steady fluidising gas velocity upwardly through the bed. An alternative method of maintaining the required reaction temperature is to introduce externally generated heat into the fluidised bed. This may be achieved by sitting the fluidised bed reactor within a furnace or otherwise applying heat to it externally and/or by preheating solids or gas entering the bed, for example preheating the chlorine-containting gas or a constituent thereof. If desired, the required reaction temperature may be maintained partly under the influence of reaction between oxygen and carbon in the bed and partly by the introduction to the bed of externally generated heat.

It is found that, if the reaction temperature is allowed to drop unduly towards, or below, 900° C., the combustion process which provides the necessary extra amount of heat to enable the practical operation of the process becomes markedly less efficient. If the reaction temperature is allowed to rise excessively there may be an unacceptable degree of chlorination of the chromium content of the ore. Preferably, according to the invention the reaction temperature is greater than 920° C. and not greater than 1050° C. Particularly preferably the reaction temperature is greater than 920° C. and not greater than 1000° C.

The selectivity of attack of iron with respect to chromium of the present invention and the formation of ferrous chloride in contrast to ferric chloride and the accompanying economics of practical operation are related to the concentration of chlorine in the chlorine containing gas used and the depth of the fluidised bed. The use of at least the above stated minimum quantity of carbon essential to this invention helps to ensure that the quantity of carbon does not act as a limiting factor which might disturb the controlling effect of the chlorine concentration. According to the invention the chlorine reacts with the iron content of the bed to form ferrous chloride in preference to ferric chloride and to chromium chlorides and the ferrous chloride formed will be carried out of the bed as a vapour. At temperatures not greater than 1000° C. ferrous chloride tends to deposit on the interior of plant, for example the interior of pipes, to form accretions which may prevent the process from proceeding. According to the invention, however, the partial pressure of the ferrous chloride vapour is controlled relative to the temperature of the fluidised bed by which means deposition of ferrous chloride may be avoided or minimised. Where the reaction temperature is not greater than 1000° C. the partial pressure of the ferrous chloride in the effluent from the bed is maintained, preferably, at below 0.006 (T-900)$+0.2\times10^5$ N per $m^2$ and, particularly preferably, at below 0.005 (T-900)$+0.2\times10^5$ N per $m^2$ where T is the reaction temperature. The partial pressure of the ferrous chloride is a function of the chlorine concentration of the gases entering the bed, since, up to an upper limit at which ferric chloride and/or chromium chloride formation occurs, the quantity of ferrous chloride in the gases in the fluidised bed rises with the chlorine concentration of the gases entering the bed. Above that limit the formation of ferric chloride instead of ferrous chloride tends to decrease the ferrous chloride partial pressure and the formation of a restricted quantity of ferric chloride may therefore be used as a means of process control. Preferably the partial pressure of ferrous chloride in the effluent from the bed is controlled by control of the concentration of chlorine admitted to the bed. Desirably ferric chloride is formed in a quantity of less than 1 mole for each mole of ferrous chloride, preferably for each 3 moles of ferrous chloride and particularly preferably, for each 5 moles of ferrous chloride. The concentration of chlorine in the gases entering the fluidised bed is, preferably, from 25% to 55% and, particularly preferably, from 30% to 50% by volume the balance preferably comprising the oxygen, of any, and a suitable inert gaseous diluent such as nitrogen.

It is an advantageous feature of the invention that ferrous chloride, is formed with no, or no more than the aforementioned restricted quantity of, ferric chloride. Chromium chlorides tend to be formed concurrently if ferric chloride is formed resulting overall in the disadvantages of loss of chromium from the product, an increased chlorine requirement and a tendency for the deposition of a proportion of the chromium chloride in the fluidised bed.

The present process may be applied, particularly economically, to a partial upgrading of material by substantially completely removing the iron from a proportion of material and blending the resulting substantially iron-free material with untreated material to give a mixed product with a somewhat reduced average iron content. Such a mixed product may be acceptable as a raw material for the production of "ferrochrome". Alternatively, the substantially iron-free material itself or a material from which a proportion only of the iron has been removed may be a desired product of this invention.

Chromite sand is a particularly suitable raw material for the last mentioned embodiment of the present process since the larger particle size fraction thereof is suitable for direct fluidisation and the "blending-back" operation may be performed to achieve a reasonable homogeniety without further special processing.

Chromite contains a number of minor constituents either incorporated in the spinel structure or as separate phases. Aluminium may be present in the region of about 10% weight calculated as $Al_2O_3$ and magnesium may be present in up to over 20% as calculated in MgO. The majority of the aluminium and up to 60% of the magnesium content of the ore may remain unchlorinated. This is not regarded as a disadvantage if the product is intended for metallurgical processing. Chromite may also contain silica as a separate phase which, in the case of chromite sand, is present in the form of discrete grains of silica. Such grains of silica are finely divided and where only the larger particle size fraction of the chromite is to be treated according to the invention the majority of the silica remains in the unchlorinated fine particle size fraction and, therefore, does not affect the operation of the invention.

The start-up procedure for the process of this invention may vary considerably. According to one suitable procedure a mixture of the material to be upgraded and carbon may be formed into a fluidised bed, using an inert fluidising gas, preheated by externally evolved heat and then, when the required temperature has been reached, reacted with chlorine in a chlorine-containing gas which may be the fluidising gas and may contain oxygen if it is desired to generate the required temperature, at least partly, in the bed. According to a further suitable procedure the material to be upgraded may be formed into a fluidised bed using air; the bed may be preheated by externally evolved heat the carbon then added and the chlorine-containing gas, with or without added oxygen as appropriate, and as a replacement for the air as the fluidising gas if desired, introdued. According to a preferred and particularly efficient procedure a mixture of the material to be upgraded and carbon is formed into a fluidised bed using air as the fluidising gas and the preheating is conducted, at least partly, by reaction between oxygen contained in the air and carbon in the bed. When the required reaction temperature has been attained the chlorine-containing gas may be introduced for example as a proportion of the fluidising gas. It will be apparent that modifications to the aforementioned procedures may readily be devised such as, for example, the utilisation of a mixture of oxygen and a diluent gas in replacement for air, without departing from the present invention.

The process may be operated batchwise or continuously. The former may be preferred if it is desired to remove substantially all, of the iron from the material and the latter otherwise. The upgraded material withdrawn from the bed may, if desired, be treated to separate it from residual carbon.

The gaseous effluent from the fluidised bed, containing ferrous chloride, may be treated to regenerate the chlorine content thereof. Preferably the gaseous effluent from the fluidised bed, containing ferrous chloride vapour, is contacted with a quantity of oxygen in excess of that required stoichiometrically for the conversion of the ferrous chloride to ferric oxide and chlorine, the partial pressure of the ferrous chloride in the gaseous effluent being at a sufficiently low level to prevent liquefaction of the ferrous chloride for at least the first two seconds after the said contact, the effluent having a velocity sufficient to entrain the particles of ferric oxide produced and separating the particles of ferrix oxide thereby formed from the residual chlorine containing effluent. The regenerated chlorine, after any necessary treatment to increase its purity may be used in the upgrading of further material. Such a cyclic process is a particularly advantageous embodiment of the present invention.

The invention will now be illustrated by means of the following Examples. The reaction chamber used in both Examples comprises a vertical fused silica cylinder, 150 mm in internal diameter and approximately 2 m long, having a conical basal section, an entry for solid reactants at the top of the reaction chamber, an entry for gases at the base of the conical section, a means of removing solids from the basal section, an exit for volatile products of reaction from the top of the reaction chamber passing to a cyclone, and thermocouples in fused silica sheaths suitably positioned near the top and bottom of the reaction chamber. The chamber is situated in a heated enclosure to effect temperature control.

The material to be upgraded in both Examples is chromite ore assaying as follows by weight:

| | | | |
|---|---|---|---|
| 30.2% | $Cr(Cr_2O_3$ 44.1%) | 15.8% $Al_2O_3$ | 1.6% $SiO_2$ |
| 22.6% | FeO | 8.7% MgO | 0.21% MnO |
| 3.6% | $Fe_2O_3$ | | 0.12% CaO |

The coke used for this example has substantially all particles in the size range 90 to $1800\times10^{-6}$ meters.

The particle size analysis of the coke as used for the example is:

| Aperture-microns | Cumalative % |
|---|---|
| +1200 | 16.5 |
| +710 | 48.8 |
| +500 | 66.5 |
| +300 | 84.2 |
| +210 | 90.9 |
| +150 | 95.2 |
| +125 | 97.6 |
| −125 | 100.0 |

The ore used in both examples has substantially all particles in the size range 106 to $250\times10^{-6}$ meters.

The particle size analysis of the ore is:

| Aperture-microns | Cumulative % |
|---|---|
| +250 | 0 |
| +212 | 6.3 |
| +180 | 32.7 |
| +150 | 57.7 |
| +125 | 82.6 |
| +106 | 92.4 |
| −106 | 100.0 |

Nitrogen and chlorine gases used for the examples are obtained from liquid storage.

EXAMPLE 1

The reaction chamber was preheated whilst passing a flow of nitrogen, at approximately 36 1 $min^{-1}$ through the gas entry.

A mixture of 24.0 Kg of the chromite ore and 6.0 Kg of the petroleum coke were placed in the reaction chamber where the flow of nitrogen caused the solids to take the form of a fluid bed. This bed was preheated to a temperature within the range 950° C. to 1000° C. and maintained within this range during subsequent reaction.

To effect reaction, the fluidising flow of nitrogen was replaced by a mixture of 33% by volume chlorine in nitrogen flowing at 36.0 1 $min^{-1}$. This state was maintained for 180 minutes, during which time small samples of the bed were removed for examination.

At the end of this time period, the fluidising gas was changed back to approximately 36 1 $min^{-1}$ nitrogen, the bed and chamber were allowed to cool and the bed recovered. After only a few minutes of reaction the bed colour had changed from the black of chromite ore to a dark green colour similar to chromium +3 oxide. This rapid change indicated that the initial attack was at the surface of the particles and further attack moved progressively toward the centre consistent with the known topochemical behaviour of chromite to reagents. The formation of the green colour indicated that the chromium was attacked only slowly or not at all despite the relatively high exposure of the chromium oxide at the surface of the particles to the chlorine..

Solids, recovered by allowing the product gases to cool, consisted mostly of iron chlorides, in which the molar ratio of ferric chloride to ferrous chloride was 1:18.

The remaining gaseous products of reaction were analysed for nitrogen, carbon monoxide, and carbon dioxide contents. In this example the mole ratio $CO_2/CO$ was 1.66 but this may vary depending on the reaction conditions used.

The recovered bed was found to be a mixture of 4.1 Kg of residual coke and 15.2 Kg of green coloured product. The chromium and iron contents of the separated product, calculated as the metals, are compared with those of the original ore in the following Table

| Component | Original Ore | Treated Ore |
|---|---|---|
| Cr % | 30.2 | 38.9 |
| Fe % | 20.1 | 2.0 |

The treated ore also contaned: 19.2% $Al_2O_3$; 0.10% CaO, 1.5% $SiO_2$; 0.04% MnO; 10.7% MgO.

Allowing for the material removed as samples during reaction, the efficiency of recovery of chromium values in treated ore was 94%.

EXAMPLE 2

The ore was introduced into the reaction chamber as in Example 1 and preheated in the fluidised state in the presence of a flow of 36 1 $min^{-1}$ air for 30 min. Coke was added and then fluidisation with 33% chlorine in nitrogen mixture was started as in Example 1. The same behaviour was found. The final product was similar to that indicated above and contained 40.5% Cr; and 1.6% Fe (both present as oxides); 19.7% $Al_2O_3$; 9.1% MgO; 1.8% $SiO_2$; 0.12% CaO and 0.01% MnO.

It is deduced from the results of the Examples that the attack by chlorine, under the specified conditions, on chromite ore may be so sensitive that iron is removed from the chromite particles leaving a product low in iron and enriched with chromium. Other elements present in the ore may be removed to a lesser or greater extent, but the removal of these may not be so critical to the further processing of the ore as is that of iron.

The removal of various elements from the ore within preceding Examples may be summarised as follows:

| Element | Amount of element removed % | |
|---|---|---|
| | Example 1 | Example 2 |
| Fe | 92 | 94 |
| Mn | 85 | 95 |
| Si | 25 | 19 |
| Ca | 20 | 25 |
| Mg | 0 | 22 |
| Al | 0 | 7 |

We claim:

1. A process for upgrading a material containing oxide of iron in combination with oxide of chromium by reacting at least a portion of the iron content thereof with chlorine and removing the resulting iron chloride as vapour leaving a higher proportion of chromium oxide, which comprises:

(a) forming a fluidised bed having an expanded bed depth of at least 1 meter said bed comprising the said material in finely divided form and finely divided carbon, the carbon being present in the bed in at least sufficient quantity to react with any oxygen added to or evolved in the bed and in at least 15% of the total weight of the carbon and of the said material;

(b) maintaining a reaction temperature of from 900° C. to 1,100° C. in the bed;

(c) admitting to the bed a chlorine-containing gas giving a concentration of chlorine of from 20% to 60% by volume of the gases added to the bed whereby the chlorine reacts with iron present in the said material to produce ferrous chloride and less than 1 mole of ferric chloride for each 3 moles of the ferrous chloride;

(d) maintaining the partial pressure of ferrous chloride in the gaseous effluent from the bed at a sufficiently low level to prevent liquefaction of the ferrous chloride;

(e) removing the gaseous ferrous chloride-containing effluent from the bed; and (f) recovering the residual upgraded chromium oxide containing bed material.

2. A process as claimed in claim 1 wherein the reaction temperature is maintained under the influence of an exothermic reaction between free oxygen admitted to the bed and carbon in the bed.

3. A process as claimed in claim 2 wherein there is admitted to the bed sufficient free oxygen to maintain the reaction temperature by reaction with carbon in the bed.

4. A process as claimed in claim 1 wherein the reaction temperature is maintained greater than 290° C.

5. A process as claimed in claim 4 wherein the reaction temperature is maintained not greater than 1050° C.

6. A process as claimed in claim 2 wherein the quantity of introduced oxygen at any point in the bed does not exceed 10% by volume of the total gaseous input into the bed.

7. A process as claimed in claim 1 wherein the said material is chromite.

8. A process as claimed in claim 1 wherein the said material contains substantially no particles outside the range of $75\times10^{-6}$ m to $500\times10^{-6}$ m in diameter.

9. A process as claimed in claim 8 wherein the said material has an average particle size of from $150\times10^{-6}$ m to $250\times10^{-6}$ m in diameter.

10. A process as claimed in claim 1 wherein the said material is a naturally occuring sand.

11. A process as claimed in claim 1 wherein carbon is present in the bed in at least 20% of the total weight of the carbon and of the said material.

12. A process as claimed in claim 11 wherein carbon is present in the bed in from 20% to 50% of the total weight of the carbon and of the said material.

13. A process as claimed in claim 1 wherein the carbon contains substantially no particles outside the range of $75\times10^{-6}$ m to $2000\times10^{-6}$ m in diameter.

14. A process as claimed in claim 13 wherein the carbon is of a coarser average particle size than that of the said material.

15. A process as claimed in claim 14 wherein the average particle size of the carbon is from $500\times10^{-6}$ to $800\times10^{-6}$ m in diameter.

16. A process as claimed in claim 1 wherein, in operation, the bed depth is from 1 to 2.5 m.

17. A process as claimed in claim 1 wherein the partial pressure of ferrous chloride in the gaseous effluent from the bed is maintained at below $0.006(T-900)+0.2\times10^5$ N per $m^2$, where T is the reaction temperature, while the temperature in the bed is below 1000° C.

18. A process as claimed in claim 17 wherein the partial pressure of ferrous chloride in the gaseous effluent from the bed is controlled by control of the concentration of chlorine admitted to the bed to allow the formation of ferric chloride in a quantity of less than 1 mole for each 3 moles of ferrous chloride formed.

19. A process as claimed in claim 1 wherein the concentration of chlorine admitted to the bed is from 30% to 60% by volume.

20. A process as claimed in claim 19 wherein the concentration of chlorine admitted to the bed is from 40% to 60% by volume.

21. A process as claimed in claim 1 conducted continuously.

22. A process as claimed in claim 1 wherein the ferrous chloride is treated to regenerate chlorine therefrom.

23. A process as claimed in claim 22 wherein the gaseous effluent from the fluidised bed, containing ferrous chloride vapour, is contacted with a quantity of oxygen in excess of that required stoichiometrically for the conversion of the ferrous chloride to ferric oxide and chlorine, the partial pressure of the ferrous chloride in the gaseous effluent being at a sufficiently low level to prevent liquefaction of the ferrous chloride for at least the first two seconds after the said contact, the effluent, having a velocity sufficient to entrain the particles of ferric oxide produced and separating the particles of ferric oxide thereby formed from the residual chlorine containing effluent.

24. A process as claimed in claim 23 wherein the chlorine, after any necessary purification treatment, is used in the upgrading of further said material.

25. The process of claim 1 wherein in step (c) the balance of the gas admitted comprises a gas selected from the group consisting of oxygen, an inert gaseous diluent and mixtures thereof.

* * * * *

UNITED STATES PATENT AND TRADEMARK OFFICE

CERTIFICATE OF CORRECTION

PATENT NO. : 4,279,640

DATED : July 21, 1981

INVENTOR(S) : Michael Robinson

It is certified that error appears in the above—identified patent and that said Letters Patent is hereby corrected as shown below:

Col. 6, line 47, - "introdued" should read -- introduced --

Col. 9, line 2 of Claim 4; - "290" should read -- 920 --

Signed and Sealed this

*Eighth* Day of *December 1981*

[SEAL]

*Attest:*

GERALD J. MOSSINGHOFF

*Attesting Officer* *Commissioner of Patents and Trademarks*